United States Patent [19]

Subramanian et al.

[11] 4,227,924

[45] Oct. 14, 1980

[54] PROCESS FOR THE PRODUCTION OF VERMICULAR CAST IRON

[75] Inventors: Sundaresa V. Subramanian, Hamilton; Debabrata S. Ghosh, Ottowa, both of Canada; John M. Gray, Stamford, Conn.; David A. R. Kay, Burlington; Gary R. Purdy, Hamilton, both of Canada

[73] Assignee: Microalloying International, Inc., Stamford, Conn.

[21] Appl. No.: 907,005

[22] Filed: May 18, 1978

[51] Int. Cl.[2] ..... C22C 33/08

[52] U.S. Cl. ..... 75/130 R; 75/53; 75/123 CB; 75/123 E

[58] Field of Search ..... 164/55–58, 164/33; 75/55, 53, 57, 130 R, 123 CB, 123 E

[56] References Cited

U.S. PATENT DOCUMENTS

| | | | |
|---|---|---|---|
| 3,336,118 | 8/1967 | Newitt | 75/53 |
| 3,765,876 | 10/1976 | Moore | 75/130 R |
| 3,816,103 | 6/1974 | Link | 75/53 |

*Primary Examiner*—P. D. Rosenberg
*Attorney, Agent, or Firm*—Barry Kramer

[57] ABSTRACT

Process for producing vermicular cast iron comprising: (i) forming a near eutectic melt having a sulfur content preferably less than about 0.025% by weight; (ii) admixing at least one rare earth-containing additive with said melt to form stable rare earth oxysulfides thereby reducing and maintaining the Henrian sulfur activity in the melt at between about 0.004 and 0.035; and (iii) thereafter, allowing said melt to solidify.

9 Claims, 5 Drawing Figures

PROCESS FOR THE PRODUCTION OF VERMICULAR CAST IRON

Figure 1:
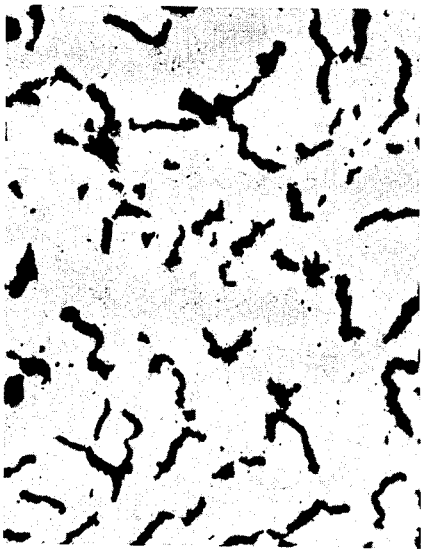

This invention relates to cast iron having a uniformly distributed vermicular or compacted graphite morphology throughout the structure. More particularly, this invention relates to processes which effect graphite morphology control enabling rapid and reliable production of cast iron exhibiting an essentially uniform vermicular graphite morphology.

Vermicular cast iron, which is also known as quasi-flake or compacted graphite cast iron, has been known for many years. The physical properties of vermicular cast iron fall intermediate between those of gray cast iron which is characterized by a flake graphite structure and ductile or nodular cast iron which is characterized by a spherulitic graphite structure.

Vermicular cast iron has become of interest for applications which call for tensile strengths approaching those of ductile irons combined with good casting properties and thermal conductivity normally associated with gray cast irons. Such combinations of properties are especially useful in such applications as ingot molds, engine blocks, and the like.

The Table below compares typical physical properties of gray cast iron, vermicular cast iron and nodular ductile cast iron.

TABLE

| Cast Iron Type | Approx. Carbon Equivalent | Tensile Strength (psi) | 0.1% Offset Yield Strength (psi) | Thermal Conductivity Cal/cm$^2$/S/°C./cm |
|---|---|---|---|---|
| Gray Class 30 | 4.2 | 30,000 | 20,000 | 0.120 |
| Vermicular | 4,2 | 30,000(1)–90,000(2) | 25–60,000 | 0.118 |
| Nodular | 4.2 | 60–100,000 | 40–80,000 | 0.08 |

(1)ferritic matrix;
(2)pearlitic matrix

Initially, the obtainment of vermicular cast iron was a by-product of efforts to obtain nodular cast iron. Early attempts to obtain nodular iron involved the use of rare earths. Nodular iron was obtained by cerium treatment of hyper-eutectic irons; however, compacted graphite accompanied by substantial amounts of eutectic carbides were obtained when hypo-eutectic irons were similarly treated (H. Morrogh, AFS Transactions, Vol. 56, pp. 72–90 (1948). In addition, N. A. Vornova et al, Russian Castings Production, pp. 531–533 (December 1968) produced cast iron employing cerium addition, which cast iron was characterized by a non-uniform graphite morphology which included vermicular graphite as well as large amounts of eutectic carbides. The cerium-treated iron was regarded as being highly sensitive to the cooling rate. Cerium treatment for the production of nodular graphite was rapidly overtaken by magnesium treatment which was more controllable, was equally applicable to both hypo- and hyper-eutectic irons and was more favorable from an economic viewpoint (see U.S. Pat. No. 2,485,760—K. D. Millis et al). Thus, rare earth addition soon became relegated to a secondary role, i.e., that of treatment of tramp elements such as antimony, lead and bismuth present in cast irons and which, in the absence of such treatment, would otherwise affect the nodularity of the graphite. Nevertheless, it is quite difficult to add magnesium to liquid cast iron. The magnesium vaporizes and burns with violent and spectacular pyrotechnics and gives rise to atmosphere polluting reactions. Attempts to overcome these problems have led to the use of expensive magnesium alloys, e.g., nickel-magnesium alloys. In addition, processes have been developed which limit the magnesium content of the alloy in an attempt to reduce the violence of the reaction and the evolution of fume. Other approaches have been to limit magnesium content by adding other elements such as alkaline earths particularly, barium and calcium in iron based alloys to reduce magnesium vaporization loss.

The major disadvantage of magnesium technology, however, can be attributed to the reoxidation of MgS by oxygen entering from the air and/or from chemically unstable refractory sources by the reaction: $MgO+1/2O_2 \rightleftharpoons MgS+S$, thereby reverting sulfur back into solution which leads to degeneration of growth structure.

Compared with the production techniques employed for gray iron castings, that for ductile iron castings requires more care and control at all stages. Needless to say, consistently achieving a structure intermediate between that of gray iron and ductile iron is even more ticklish and demanding. As a result, vermicular cast irons have not heretofore achieved significant commercial success because of the inability to produce such structures in a rapid and reliably controlled fashion.

Attempts to deliberately obtain vermicular cast iron have heretofore centered about treatment with magnesium as a logical extension from nodular iron technology. The problem with magnesium, however, is the critical range within which magnesium is effective to provide the vermicular graphite structure. Too little magnesium does not produce full vermicular structure; while over-treatment produces nodular graphite. The difference between under- or over-treatment can be as little as 0.005% magnesium. Wider latitude or tolerance for magnesium has been obtained by using magnesium in conjunction with both titanium and rare earths, with the titanium tending to suppress the formation of nodular graphite. In such cases, however, a further complication is encountered in the formation of additional inclusions of titanium carbides and nitrides (see U.S. Pat. No. 3,421,886—R. D. Schelleng). Moreover, the problem of nitrogen porosity in castings has been attributed to the presence of titanium.

In view of the many problems associated with the use of magnesium and magnesium-containing alloys when used in conjunction with molten cast irons, it is an object of the present invention to provide processes for reliably and rapidly producing vermicular cast iron without the use of magnesium or titanium-containing alloys.

It is another object of the present invention to provide processes for the controlled production of vermicular cast iron characterized by an essentially uniformly distributed vermicular graphite morphology with the substantial absence of eutectic carbides.

It is still another object to provide vermicular cast iron which is insensitive to variations in cooling rate.

These, as well as other objects can be achieved through the present invention which provides a process for controllably producing vermicular cast iron comprising:

(i) forming a near eutectic melt having a sulfur content less than about 0.025% by weight;

(ii) admixing at least one rare earth-containing additive with said melt to form stable rare earth oxysulfides thereby reducing and maintaining the Henrian sulfur activity in the melt at between about 0.004 and 0.035; and (iii) thereafter, allowing said melt to solidify.

Figure 3:
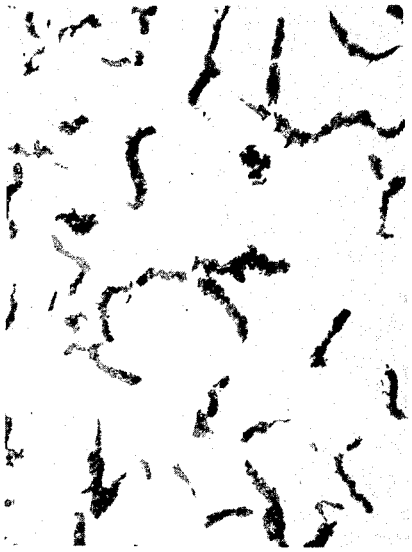
Figure 4:
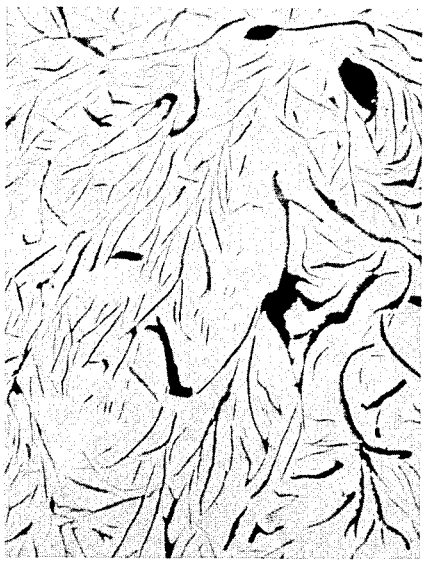
Figure 5:
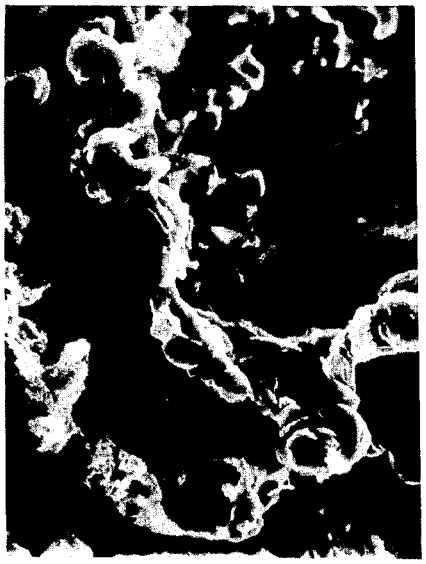
Figure 2:
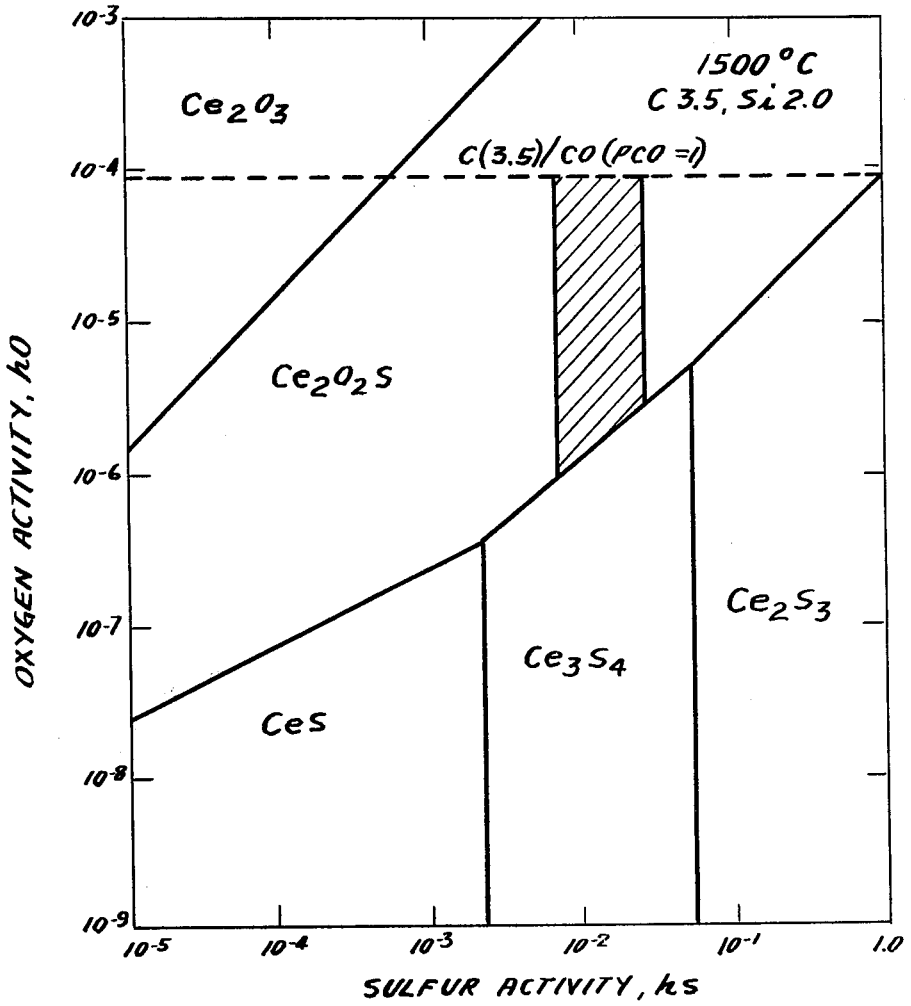

The present invention is discussed in detail hereinbelow with reference to the drawing wherein:

FIG. 1 is an optical micrograph (200X) of a polished section of a slowly cooled vermicular cast iron prepared in accordance with the present invention. The vermicular graphite (dark) is shown uniformly distributed throughout a ferritic (light) matrix. It should be noted that the vermicular cast iron is further characterized by the absence of eutectic carbides;

FIG. 2 is a graphical representation of the Henrian oxygen activity in equilibrium with the Henrian sulfur activity in an iron melt having an effective carbon concentration of 3.5 wt.% and silicon concentration of 2.0 wt.% at 1500° C. The graph illustrates regions wherein various rare earth compounds exist as a stable phase. In particular, the region is illustrated wherein the stable rare earth oxysulfide phase exists and, within said region, the combination of Henrian sulfur and oxygen activity equilibrium levels (shaded area) which give rise to the formation of a cast iron having a uniformly distributed vermicular graphite morphology therein upon cooling of the melt. The horizontal dotted line represents the equilibrium oxygen level attributable to the presence of 3.5 wt.% carbon in the melt at a carbon monoxide partial pressure of one atmosphere at 1500° C.;

FIG. 3 is an optical micrograph (100X) of a polished section of a mold test block treated in accordance with the present invention. The vermicular graphite (dark) is thick and elongated with a worm-like appearance. The matrix is ferritic (light); and FIG. 4 is an optical micrograph (100X) of a polished section of an untreated mold test block showing long flakes of graphite (dark) in a ferritic (light) matrix. The graphite flakes are interconnected in three dimensions;

FIG. 5 is a micrograph obtained by scanning electron microscopy which illustrates the structure of the vermicular graphite after etching away the iron matrix.

The Henrian activity of any component i, $h_i$, in solution in iron is the effective concentration of that component in the iron melt and is given by $$h_i = f_i \times [w\%\ i]$$

where [w% i] is the weight percent of component i and $f_i$ is the Henrian activity coefficient of component i. The activity coefficient, $f_i$, can be calculated from the relationship:

$$\log f_i = \sum_{j=1}^{n} e_i^j [w\%\ j] + \sum_{j=1}^{n} \gamma_i^j [w\%\ j]^2$$

where $e_i^j$ and $\gamma_i^j$ are first-order and second-order interaction parameters previously determined for the system of interest by conventional thermodynamic techniques such as set forth in "Thermodynamics of Alloys", Carl Wagner, Addison-Wesley Publishing Company, Reading, Mass. (1952).

The processes of the present invention are based on the discovery that controlled addition of rare earths will form a stable rare earth oxysulfide phase in the region of Henrian sulfur and oxygen activities required for the production of vermicular graphite morphology. In comparison, magnesium sulfide formed during magnesium treatment, readily reoxidizes returning sulfur into solution thus causing transition of the structure back to unmodified coarse flake. The rare earth reaction is more easily controlled as compared with magnesium which invariably gives rise to violent vapor phase reactions involving pyrotechnics. The extensive solubility of rare earths in iron makes it possible to obtain a wide range of sulfur and oxygen concentrations in iron. Thus, levels of sulfur and oxygen intermediate between flake and spherulite morphology are more easily obtained with rare earths. Moreover, rare earth reaction products act as effective substrates for graphite nucleation and do not float out at the fast rates typical of calcium and magnesium treatment products.

The processes of the present invention are commenced by melting conventional base irons of near eutectic composition and of low sulfur content, i.e., less than about 0.025% by weight and preferably, about 0.01 to 0.02% by weight sulfur, as would be conventionally employed in nodular iron production technology. The iron to be treated is of a composition which would solidify as gray iron in the untreated condition. The composition range of the base metal generally ranges from about 3.0 to 4.5% by weight of carbon; about 1.0 to 3.5% by weight silicon; up to about 1.2% by weight manganese; less than about 0.1% by weight phosphorus and the balance being iron. The exact amount of manganese employed is not considered critical to the process of the present invention. The manganese concentration is dictated primarily by matrix structure requirements which may vary depending upon the particular application and cooling rate. If desired, additional alloying elements such as nickel, molybdenum, copper and chromium can also be used for special purposes. However, the refinement of the structure to produce vermicular graphite results in properties in an unalloyed iron that are equivalent to, yet less expensive than alloyed gray iron.

It has been found that selection of the base iron composition plays a significant role in the elimination of eutectic carbides from the cast iron product. It has been found that although graphite morphology can be controlled within the broad range of 1.0 to 3.5% by weight silicon, selection of the base iron composition or ferrosilicon addition to provide 2.0 to 3.5% by weight silicon in the final product minimizes formation of eutectic carbides.

If the silicon level in the base iron is less than 2% by weight, then inoculation of the melt with ferrosilicon can be employed to increase the silicon level of 2.0% or more. If the silicon level in the base iron is in the range of 2.0 to 3.5% by weight, ferrosilicon addition is not considered necessary.

If the sulfur level is greater than 0.025% by weight, the melt is first desulfurized to a level below about 0.025% by weight and preferably to about 0.01 to 0.02% by weight by conventional desulfurization procedures. Thus, for example, external desulfurization using calcium carbide or soda ash as desulfurizing agents and the porous plug method as a means of agitating the metal can be suitably employed. Alternatively, methods such as the Magcoke desulfurization technique can be employed depending upon which approach is more economically feasible. Such desulfurization techniques can be avoided if the base metal employed possesses a sulfur content in the range of about 0.01 to 0.02% by weight.

Once the molten iron is at the requisite sulfur level, it is treated with at least one rare earth-containing additive to reduce the Henrian sulfur activity in the melt to between about 0.004 and 0.035 and preferably, to between about 0.0075 and 0.0265 (as shown in FIG. 2). The rare earths are generally regarded as the elements of the Lanthanide series of the Periodic Table of the Elements and also generally include yttrium. Thus, rare earths such as cerium, praseodymium, neodymium, promethium, samarium, europium, gadolinium, terbium, dysprosium, holmium, erbium, thulium, lutecium and mixtures thereof can be suitably employed. Similarly, ores, compounds or metals containing a mixture of rare earths such as rare earth fluorides, rare earth fluoro-carbonates, misch metal, rare earth silicides, rare earth aluminum silicide alloys, nickel-cerium alloys, and the like, can be suitably employed. The amount of rare earth to be added to the molten iron can be determined on the basis of reaction stoichiometry for rare earth oxysulfide formation, since the oxysulfide is the stable equilibrium phase for the sulfur and oxygen levels in the compacted graphite region. Thus, depending on the sulfur level of the melt after the initial desulfurization and the recovery rate, sufficient rare earth-containing additive is added to the melt to combine with the oxygen and sulfur present in the system forming a stable rare earth oxysulfide phase and thereby controllably reducing the residual soluble sulfur to the desired level of Henrian sulfur activity (the shaded region in FIG. 2) which, upon cooling, gives rise to a cast iron of uniformly distributed vermicular graphite morphology. The reaction products of cerium, oxygen and sulfur also act as effective substrates for graphite formation. Since the density of the reaction products is higher than the density of calcium and magnesium oxides and sulfides, the nucleating efficiency is higher than for conventional systems.

Depending upon the sulfur level and the recovery rate, suitable addition rates for rare earths in accordance with the present invention have been found to range from about 0.5 to 6 pounds of rare earth per ton of molten metal. Thus, for example, at a 0.02 wt.% sulfur level and a recovery rate of 50%, an addition rate of 5.2 pounds rare earth per ton of melt has been found suitable. The rare earth-containing additive employed in the present invention can be added to the melt by conventional sandwich, plunging or porous plug treatment methods or by other methods suitable for adding reactive metals to molten iron and steel.

Other surface active elements such as selenium and tellurium and tramp elements such as tin, lead, bismuth, antimony, if present, can also be rendered innocuous by the addition of suitable quantities of rare earths. The addition rates for tramp elements are usually small, as compared with the amounts needed to produce vermicular graphite and are as practiced in current nodular iron technology.

It has also been found that addition of small amounts of a strong deoxidizer such as aluminum, titanium and the like, preferably aluminum, in the range of from about 0.02 to about 0.04 wt.% confers beneficial effects with respect to the formation of vermicular graphite and assists in improving fade resistance. However, the presence of such deoxidizers is not considered essential to the production of vermicular graphite. Levels of aluminum above about 0.05% should be avoided due to the formation of pinhole porosity. However, rare earth alloys containing up to 15% aluminum have been found to give good results. Thus, in accordance with the present invention, a suitable alloy additive containing 50% rare earth can have an aluminum content between 0 and 15%.

Subsequent to the rare earth treatment of the present invention and depending upon the silicon content of the base iron, the melt can be inoculated with ferrosilicon in the same manner as practiced for nodular iron. It has been found that local silicon concentration transients increase carbon supersaturation and enhance nucleation and growth of vermicular graphite. Generally, the melt is inoculated with from about 0.5 to 1 wt.% of melt weight with foundry grade ferrosilicon (75–80% silicon) or its equivalent.

Upon cooling of the so-treated melt, a truly vermicular cast iron is reliably obtained. It has been found that vermicular cast iron produced in accordance with the present invention is rendered less sensitive to cooling rate. The solidification of the treated and inoculated melt can be effected in any conventional manner. It has been found that although the cast irons produced in accordance with the present invention are less sensitive to cooling rate, the slow cooling inherent in sand casting is advantageous in the present invention since the decrease in the degree of undercooling favors vermicular graphite formation in preference to spherulite formation.

Unlike the fading or degeneration of spherulitic or vermicular graphite structure which arises, in a magnesium-treated system, primarily due to the reoxidation of magnesium sulfide with the reversion of sulfur into solution, it has been found in accordance with the present invention that the reaction product from rare earth treatment, i.e., rare earth oxysulfide, is stable and does not reoxidize under the oxygen concentrations existing in cast iron production systems.

The following examples further illustrate the present invention. These examples are included solely for purposes of illustration and are not to be construed in limitation of the present invention. Unless otherwise specified, all percentages and parts are by weight.

EXAMPLE 1

Melts were conducted in a 15 pound capacity magnesium oxide crucible in an induction furnace. The melt charges consisted, respectively, of sorel metal (F-1) grade and electrolytic iron. The alloys of near eutectic cast iron were synthesized from graphite rod of high purity, foundry grade ferrosilicon (75% silicon), electrolytic manganese and reagent grade ferrous sulfide. The cast iron melts obtained were within the following ranges: carbon: 3.5–3.8; silicon: 2.0–2.75; sulfur: 0.02%. Pure cerium and rare earth silicide alloy (40% rare earth mixture) were employed in successive melts. The rare earth addition was effected with a graphite plunger. The treatment temperature was maintained at about 1500° C. Fireclay molds of 1 inch diameter and 2½ inch diameter were employed. Foundry grade ferrosilicon (75–80% silicon) graded to −10+16 mesh was employed for inoculation purposes.

FIG. 1 illustrates the typical microstructure of homogeneous vermicular graphite in a ferritic matrix essentially free of eutectic carbides which was obtained in this instance.

EXAMPLES 2–6

Vermicular Graphite Ingot Mold Trials

The base metal was desulfurized using the Mag-Coke process to a low residual sulfur level, in the range of 0.010 to 0.015 wt.%. The treatment was carried out using rare earth addition rates which varied from 1.28 lbs/ton to 2.33 lbs/ton of iron. The exact addition rate in each case is given in Table II below.

TABLE II

| Example No. | Rare Earth Addition lbs/ton | Final Iron Composition (%) Total Carbon | Mn | P | Si | S | Structure |
|---|---|---|---|---|---|---|---|
| Control | Nil | 3.52 | 0.12 | 0.044 | 2.20 | .010 | Flake graphite in ferritic matrix |
| 2 | 1.57 | 3.79 | 0.08 | 0.029 | 1.93 | .005 | Compacted graphite in ferritic matrix |
| 3 | 1.28 | 3.71 | 0.08 | 0.030 | 1.97 | .004 | Compacted graphite in ferritic matrix |
| 4 | 1.62 | 3.50 | 0.17 | 0.041 | 2.08 | .003 | Compacted graphite in ferritic matrix |
| 5 | 1.41 | 3.52 | 0.10 | 0.032 | 2.19 | .003 | Compacted graphite in ferritic matrix |
| 6 | 2.33 | 3.46 | 0.08 | 0.029 | 2.14 | .002 | Compacted graphite in ferritic matrix |

Test blocks were cast alongside with each mold. A 15"×15"×8" size test block was used, representative of the thickest section of the tonnage ingot mold. 2" dia.×1" thick samples were taken from the middle position of 15"×15"×8" block for the preparation of metallographic samples.

All samples treated according to the invention showed a compacted graphite structure in a ferritic matrix (FIG. 3). The untreated control sample (FIG. 4) showed large interconnected graphite flakes in a ferritic matrix. The treated samples gave an average tensile strength of 36,000 psi.

The compact, interconnected structure of the vermicular graphite can be seen in FIG. 5.

Although specific materials and conditions were set forth in the above exemplary processes for making vermicular cast iron in accordance with this invention, these are merely intended as illustrations of the present invention. Various other base iron compositions, rare earth elements or rare earth-containing ores or alloys, ferro-silicon inoculants and treatment conditions may be substituted in the example with similar results.

Other modifications of the present invention will occur to those skilled in the art upon a reading of the present disclosure. These are intended to be included within the scope of this invention.

What is claimed is:

1. Process for producing vermicular cast iron comprising:

(i) forming a near eutectic melt having a sulfur content less than 0.025% by weight;

(ii) admixing at least one rare earth-containing additive with said melt to form stable rare earth oxysulfides thereby reducing the Henrian sulfur activity in the melt to between about 0.004 and 0.035; and (iii) thereafter allowing said melt to solidify.

2. The process of claim 1 wherein the near eutectic melt has a composition comprising about 3.0 to 4.5% by weight carbon; about 1.0 to 3.5% by weight silicon; up to about 1.2% by weight manganese, less than about 0.1% by weight phosphorus and the balance being iron, said iron composition being capable of solidifying to gray iron in untreated condition.

3. The process of claim 1 additionally comprising the step of first desulfurizing the melt from a sulfur content of above about 0.025% by weight to a sulfur content of from about 0.01 to 0.02% by weight.

4. The process of claim 1 wherein sufficient rare earth-containing additive is admixed with the melt to reduce the Henrian sulfur activity therein to between about 0.0075 to 0.0265.

5. The process of claim 1 wherein from about 0.5 to 6 pounds of rare earth metal are added per ton of molten iron.

6. The process of claim 1 wherein from about 0.02 to about 0.04 wt.% of aluminum is additionally added to the melt.

7. The process of claim 1 wherein the melt is inoculated with from about 0.5 to 1 wt.% of melt weight of ferrosilicon.

8. The process of claim 1 wherein the silicon content of the melt ranges from about 2.0 to 3.5% by weight and the resulting cast iron is further characterized by essential freedom from eutectic carbides.

9. The process of claim 7 wherein the melt is inoculated with sufficient ferrosilicon to bring the silicon concentration of the melt into the range of 2.0 to 3.5% by weight and the resulting cast iron is further characterized by essential freedom from eutectic carbides.

* * * * *